US012760932B2

(12) United States Patent
Peters et al.

(10) Patent No.: US 12,760,932 B2
(45) Date of Patent: Oct. 13, 2026

(54) BLOWER COLLAR FOR COMBUSTION SYSTEM

(71) Applicant: Rheem Manufacturing Company, Atlanta, GA (US)

(72) Inventors: Jeremy Peters, Coosada, AL (US); Madhuresh Bhandari, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 373 days.

(21) Appl. No.: 18/519,780

(22) Filed: Nov. 27, 2023

(65) Prior Publication Data

US 2024/0175603 A1 May 30, 2024

Related U.S. Application Data

(60) Provisional application No. 63/428,163, filed on Nov. 28, 2022.

(51) Int. Cl.

| | |
|---|---|
| ***F24H 9/1832*** | (2022.01) |
| ***F24H 1/18*** | (2022.01) |
| ***F24H 9/00*** | (2022.01) |
| ***F24H 9/20*** | (2022.01) |

(52) U.S. Cl.
CPC ..... *F24H 9/0005* (2013.01); *F24H 1/186* (2013.01); *F24H 9/2035* (2013.01)

(58) Field of Classification Search
CPC ..... F23N 2900/05005
See application file for complete search history.

(56) References Cited

U.S. PATENT DOCUMENTS

| | | | | |
|---|---|---|---|---|
| 4,643,672 | A * | 2/1987 | Lefebvre | F23D 11/406 239/405 |
| 5,865,616 | A * | 2/1999 | George | F23Q 3/008 239/553.3 |
| 7,559,293 | B2 * | 7/2009 | Gordon | F24H 1/205 122/18.31 |
| 9,429,337 | B2 * | 8/2016 | Lannes | F24H 9/1836 |
| 10,801,748 | B2 * | 10/2020 | Scott | F24H 1/205 |
| 11,073,303 | B2 * | 7/2021 | Porwal | F23J 15/06 |
| 12,110,707 | B2 * | 10/2024 | Roy | F23D 14/02 |
| 2012/0291719 | A1 * | 11/2012 | Steinhafel | F24H 1/00 122/18.3 |
| 2021/0341176 | A1 * | 11/2021 | Rao | F24H 9/2035 |

* cited by examiner

*Primary Examiner* — Gregory A Wilson
(74) *Attorney, Agent, or Firm* — Eversheds Sutherland (US) LLP

(57) ABSTRACT

A blower collar for use with a blower and a burner. The blower collar includes: a bottom portion having a circular opening surrounded by a burner mounting rim configured to be mounted to the burner; an upper portion having a non-circular opening surrounded by a blower mounting rim and being configured to mount to the blower; and a central portion between the bottom portion and the upper portion, the central portion having a surrounding wall connected to the burner mounting rim and the blower mounting rim, the surrounding wall surrounding an inner pass through having a cross-sectional shape that changes from the non-circular opening of the upper portion to the circular opening of the bottom portion.

17 Claims, 10 Drawing Sheets

BLOWER COLLAR FOR COMBUSTION SYSTEM

CROSS-REFERENCE TO RELATED APPLICATIONS

This application claims priority to and benefit of U.S. provisional patent application No. 63/428,163 filed Nov. 28, 2022, which is herein incorporated by reference.

FIELD

This application relates generally to water heaters and more particularly to blower collars for water heaters with a combustion system.

BACKGROUND

Typical fuel-fired water heaters use fuels, such as natural gas, propane or oil, to heat water contained in a water tank of such water heaters. With such water heaters, a heat exchanger that sits in the tank is typically used to heat the water. In some water heaters, hot gas passes through a heat exchanger once to heat the water. In other water heaters, the heat exchanger may include multiple branches, and the hot gas passes through the heat exchanger multiple times to heat the water. The multiple-branched heat exchanger can result in improved thermal efficiency. However, the arrangement of the multiple branches of the heat exchanger in the tank can present challenges to providing a top water outlet without degrading thermal efficiency of a water heater. In some cases, water heaters with a top water outlet may be preferable. Thus, a solution that allows for the construction of a water heater with a top water outlet and using a multiple-pass heat exchanger may be desirable.

A water heater is described in U.S. Pat. No. 10,801,748, the entire disclosure of which is incorporated herein by reference. This will be described in greater detail with reference to FIGS. 1-4.

FIG. 1 illustrates a perspective view of a water heater 100 that includes a water tank 102, a top cover assembly 104, and a bottom assembly 106. The water heater 100 also includes a combustion system 108 at the top end of the water heater 100. The combustion system 108 may include a down-fired burner, where hot gas flows downward into a multi-pass heat exchanger disposed in the water tank 102. The water heater 100 also includes a water inlet 112 that may be disposed, for example, closer to the bottom end of the water tank 102. The water tank 102 also includes a top water outlet 110 through the top cover assembly 104.

During operation of the water heater 100, unheated water enters the water tank 102 through the water inlet 112, and gas is heated by the combustion system 108. The unheated water gets heated inside the water tank by hot gas flowing through the multi-pass heat exchanger. The resulting heated water exits the water tank 102 through the top water outlet 110 in the top cover assembly 104. The hot gas that flows through the multi-pass heat exchanger may exit the water tank through a hot gas outlet in the bottom assembly 106.

The water heater 100 provides a top water outlet location along with the high efficiency of a multi-pass heat exchanger. By providing the top water outlet 110, the water heater 100 provides a fuel-fired water heater with a top water outlet location that is preferable in some installations.

FIG. 2 illustrates an exploded disassembled view of the combustion system 108 of the water heater 100 of FIG. 1.

Referring to FIG. 2, the combustion system 108 includes a low air/gas pressure switch 202, a street tee 204, a combustion assembly label 206, a blower 208, a plurality of screws 210, a blower gasket 212, a plurality of screws 214, a blower collar 216, a burner gasket 218, a flame sensor rod 220, an igniter (with cable) 222, a sightglass fitting 224, a burner mounting plate 226, a gasket 228, a burner plate 230, and a burner mesh 232.

The low air/gas pressure switch 202 is used to confirm gas line pressure. Some embodiments may include an alarm when there is very low, or even no, pressure in the line. The low air/gas pressure switch 202 provides a user with confirmation of gas supply. The street tee 204 may be made of brass to properly fit into a gas valve connection and connect to the gas line. The gas connection may be enlarged to ensure installers to provide enough gas to the combustion system 108 and prevent issues with ignition in the field. Brass may be used to reduce rust without having the expense of stainless steel. The combustion assembly label 206 warns a user or service person of the combustion function of this part of water heater 100. The blower 208 is a system that blows a mixture of air and a combustible gas as mixed by an internal valve. The blower 208 has a circular cross-sectional output so as to match the circular cross-sectional input of the burner mesh 232. The plurality of screws 210 are used to fasten the blower 208 to the blower collar 216. The blower gasket 212 prevents the air/gas mixture from the blower 208 from escaping between the blower 208 and the blower collar 216. The plurality of screws 214 are used to fasten the blower collar 216 to the burner mounting plate 226. The blower collar 216 is used to mount the blower 208 to the burner mounting plate 226. The burner gasket 218 prevents combusted gases from escaping between the burner mounting plate 226 and the burner plate 230. The flame sensor rod 220 detects whether the air/gas mixture as provided by the blower 208 has been ignited. The igniter (with cable) 222 ignites the air/gas mixture as provided by the blower 208. The sightglass fitting 224 enables an installer to see and verify flame in the main flue. The installer can also see the color of the flame and make some changes based on color and also how it is igniting. The burner mounting plate 226 receives the blower collar 216, having the blower 208 fastened thereon. The gasket 228 prevents combusted gas from expelling from between the burner mounting plate 226 and the burner plate 230. The burner mounting plate 226 is the actual plate that mounts the combustion system 108 to the top cover assembly 104 as shown in FIG. 1. The burner plate 230 is an insulation refractory to reduce the heat exposure of the burner mounting plate 226. The burner mesh 232 distributes the gas mixture further than just the ports on the burner and allows the flame a place to "sit" while combustion is occurring. The burner mesh 232 helps with flame stability. Further the burner mesh 232 increases distribution of the burn and lowers nitrogen oxide numbers.

The burner mounting plate 226 includes passthroughs 234, 236 and 238, whereas the burner plate 230 has passthroughs 240, 242, and 244.

The passthrough 234 of burner mounting plate 226 aligns with the passthrough 240 of the burner plate 230 and is configured to receive the flame sensor rod 220. In this way, the flame sensor rod 220 may be positioned below the burner plate 230, when assembled, so as to detect combustion within the burner mesh 232.

The passthrough 236 of burner mounting plate 226 aligns with the passthrough 242 of the burner plate 230 and is configured to receive the igniter 222. In this way, the igniter 222 may be positioned below the burner plate 230, when assembled, so as to ignite the air/gas mixture below the burner plate 230.

The passthrough 238 of burner mounting plate 226 aligns with the passthrough 244 of the burner plate 230 and is configured to receive the sightglass fitting 224. In this way, as mentioned above, the sightglass fitting 224 enables an installer to see and verify flame in the main flue. Further, the sightglass fitting 224 lets the installer see the color of the flame and make some changes based on color and also how it is igniting.

FIG. 3 illustrates an enlarged assembled view of the combustion system 108 of the water heater 100 of FIG. 1. As shown in FIG. 3, the blower 208 blows out a mixture of air and a combustible gas past the blower collar 216 and into the burner mesh 232 to be ignited by the igniter 222. The ignited mixture of air and gas is used to heat water stored in the water heater 100. This will be described in greater detail with reference to FIG. 4.

FIG. 4 illustrates a cross-sectional view of the water heater 100 of FIG. 1 without the water tank 102.

As shown in FIG. 4, a multi-pass heat exchanger 402 is positioned in the water tank. The multi-pass heat exchanger 402 includes: a first-pass flue tube 404; second-pass flue tubes, an example of which is indicated as second-pass flue tube 406; and third-pass flue tubes, a sample of which is indicated as third-pass flue tube 408.

The second-pass flue tubes extend out radially from the first-pass flue tube 404 and curve/turn generally upward toward the top opening of the water tank 102. The second-pass flue tubes are attached to the first-pass flue tube 404 forming a hot gas flow path from the first-pass flue tube 404 to the second-pass flue tubes. The hot gas in the first-pass flue tube 404 is provided by the combustion system 108, which can be a down-fired system, as more clearly illustrated in FIGS. 2 and 3.

The second-pass flue tubes are substantially parallel to the first-pass flue tube 404 after curving/turning upward. The second-pass flue tubes branch out from the first-pass flue tube 404 proximal to a bottom end of the water tank 102 and extend upward for a substantial portion of the height of the water tank 102. The second-pass flue tubes have curves or other variations in extending upward toward the top opening of the water tank 102. Top ends of the second-pass flue tubes are terminated in top flues in the top cover assembly 104 of the water heater 100 or may otherwise be in fluid communication with the top flues in the top cover assembly 104 of the water heater 100. For example, some of the second-pass flue tubes may be terminated in a first top plenum 410, and other of the second-pass flue tubes may be terminated in a second top plenum 412.

The third-pass flue tubes extend in the cavity of the water tank 102 from the top end of the water tank 102 to a bottom end of the water tank 102. Top end openings of the third-pass flue tubes may be terminated or may otherwise be in fluid communication with the top plenums 410 and 412 in the top cover assembly 104. Hot gas from the second-pass flue tubes flows to the third-pass flue tubes through the top plenums 410 and 412 in the top cover assembly 104.

The bottom end openings of the third-pass flue tubes are terminated in the bottom assembly 106 through openings in a top cover 104 of the bottom assembly 106. For example, the bottom assembly 106 includes a bottom flue 416, and hot gas flowing through the third-pass flue tubes flows to the bottom flue 416 and exit the bottom assembly 106 through a hot gas outlet 414 of the bottom assembly 106.

In operation, water is filled in the water heater 102. The combustion system 108 generates hot air, which is passed downward toward the bottom of the water heater 100 through the first-pass flue tube 404, which heats the water surrounding the first-pass flue tube 404 via conduction. By heating the water surrounding the first-pass flue tube 404, the hot air in the first-pass flue 404 is cooled somewhat as it passes through.

The somewhat-cooled hot air from the first-pass flue tube 404 is then passed upward through the second-pass flue tubes, each of which additionally heats the water surrounding the respective second-pass flue tubes. Again, by heating the water surrounding the second-pass flue tubes, the somewhat-cooled hot air is then further cooled.

The further cooled hot air from the second-pass flue tubes is diverted by the top plenums 410 and 412 and into the third-pass flue tubes.

The further-cooled hot air from the second-pass flue tubes, is then passed downward toward the bottom of the water heater 100 through the third-pass flue tubes, each of which additionally heats the water surrounding the respective third-pass flue tubes. Again, by heating the water surrounding the third-pass flue tubes, the further-cooled hot air is then still further cooled.

Accordingly, the water in the water heater 100 is heated via a combination of conduction with the heated water and convention. However, the efficiency of the combustion system 108 is not optimized. As shown in FIG. 3, the blower 208 has a spiraling shape, wherein the gases being blown out at a more radial distance move much faster than the gases being blown out at a less radial distance. This is illustrated with the long arrow 302 representing the gases being blown out at a more radial distance and the shorter arrow 304 representing the gases being blown out at a less radial distance.

As a result of the difference in velocities of the gasses exiting the blower 208, the air and combustible gas does not mix very well by the time it reaches the burner mesh 232 for ignition. This reduces the thermal efficiency of the hot water heater 100.

What is needed is a hot water heater with improved thermal efficiency.

BRIEF DESCRIPTION OF THE DRAWINGS

The detailed description is set forth with reference to the accompanying drawings. In some instances, the use of the same reference numerals may indicate similar or identical items. Various embodiments may utilize elements and/or components other than those illustrated in the drawings, and some elements and/or components may not be present in various embodiments. Throughout this disclosure, depending on the context, singular and plural terminology may be used interchangeably.

DETAILED DESCRIPTION

A water heater in accordance with aspects of the present disclosure provides improved thermal efficiency over that of the prior art water heater discussed above with reference to FIGS. 1-4.

In embodiments, a water heater includes a heat generating system in which a blower blows a mixture of air and gas from a hole having a non-circular cross-section. A blower collar is provided to pass the mixture of air and gas from the blower to a burner plate. The blower collar has an inner pass through having a cross-sectional shape that changes from the non-circular opening that matches that of the blower to a circular opening to match that of the burner plate. By using the blower collar that has such a changing pass through, the air and gas are more effectively mixed, which leads to a more efficient burn.

An example water heater in accordance with aspects of the present disclosure will now be described in greater detail with reference to FIGS. 5-9B.

Figure 1:
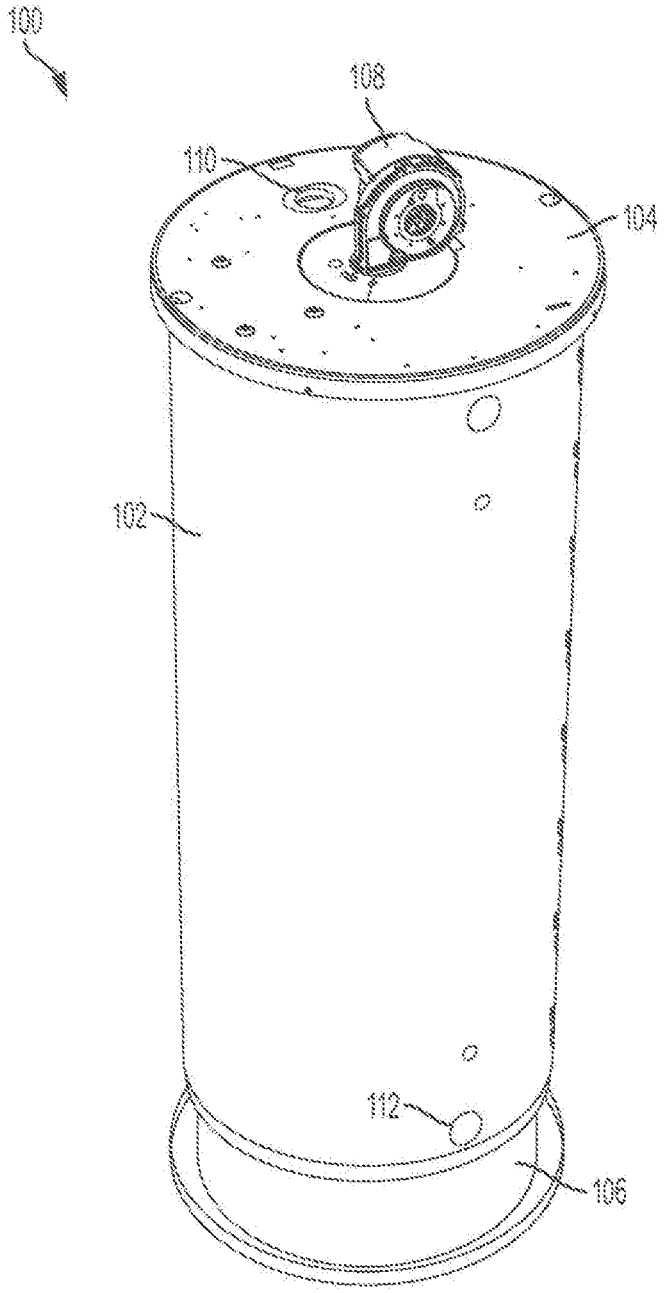
FIG. 1 Prior Art
FIG. 1 illustrates a perspective view of a prior art water heater.
Figure 2:
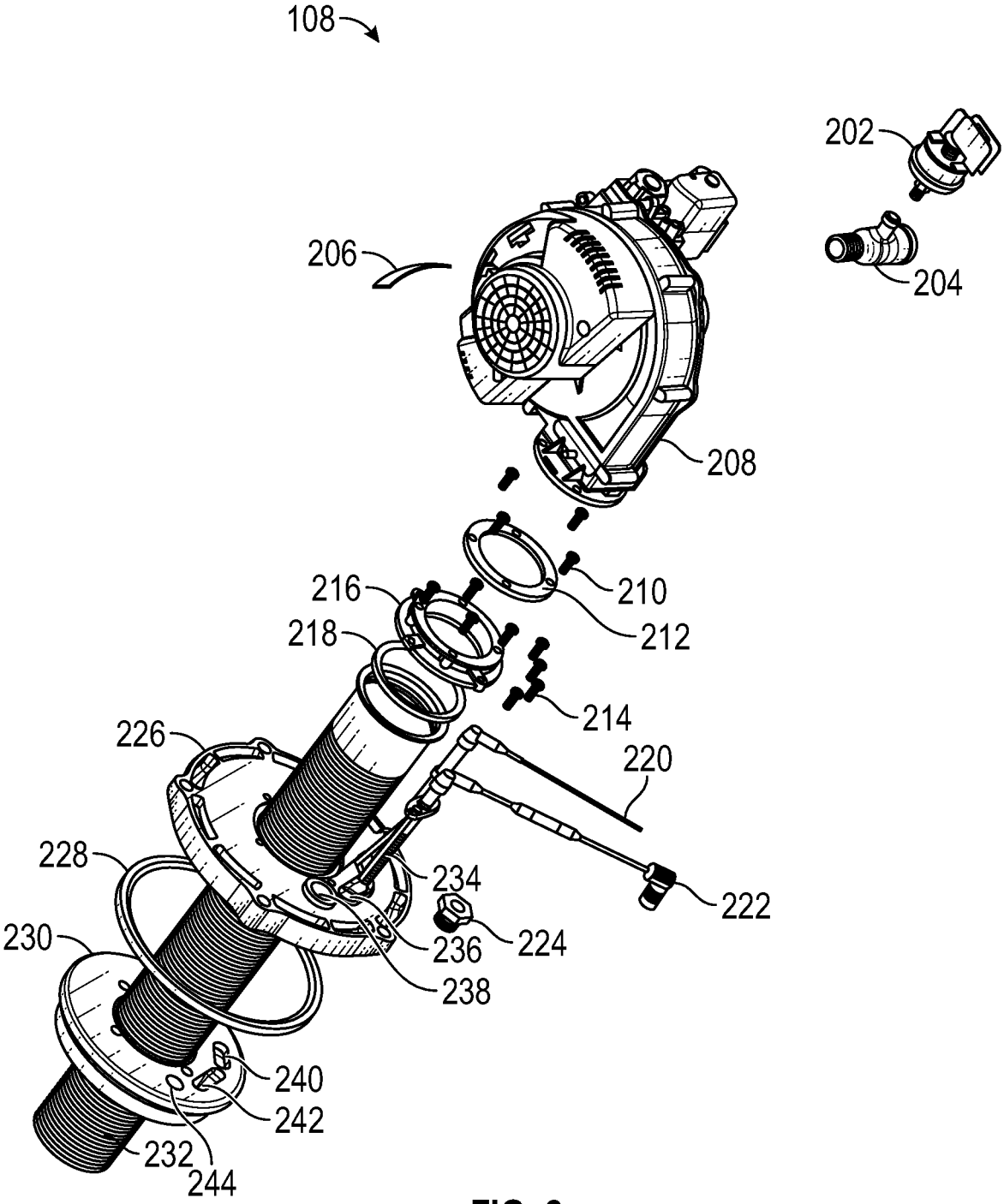
FIG. 2 (Prior Art)
FIG. 2 illustrates an exploded disassembled view of the combustion system of the water heater of FIG. 1.
Figure 3:
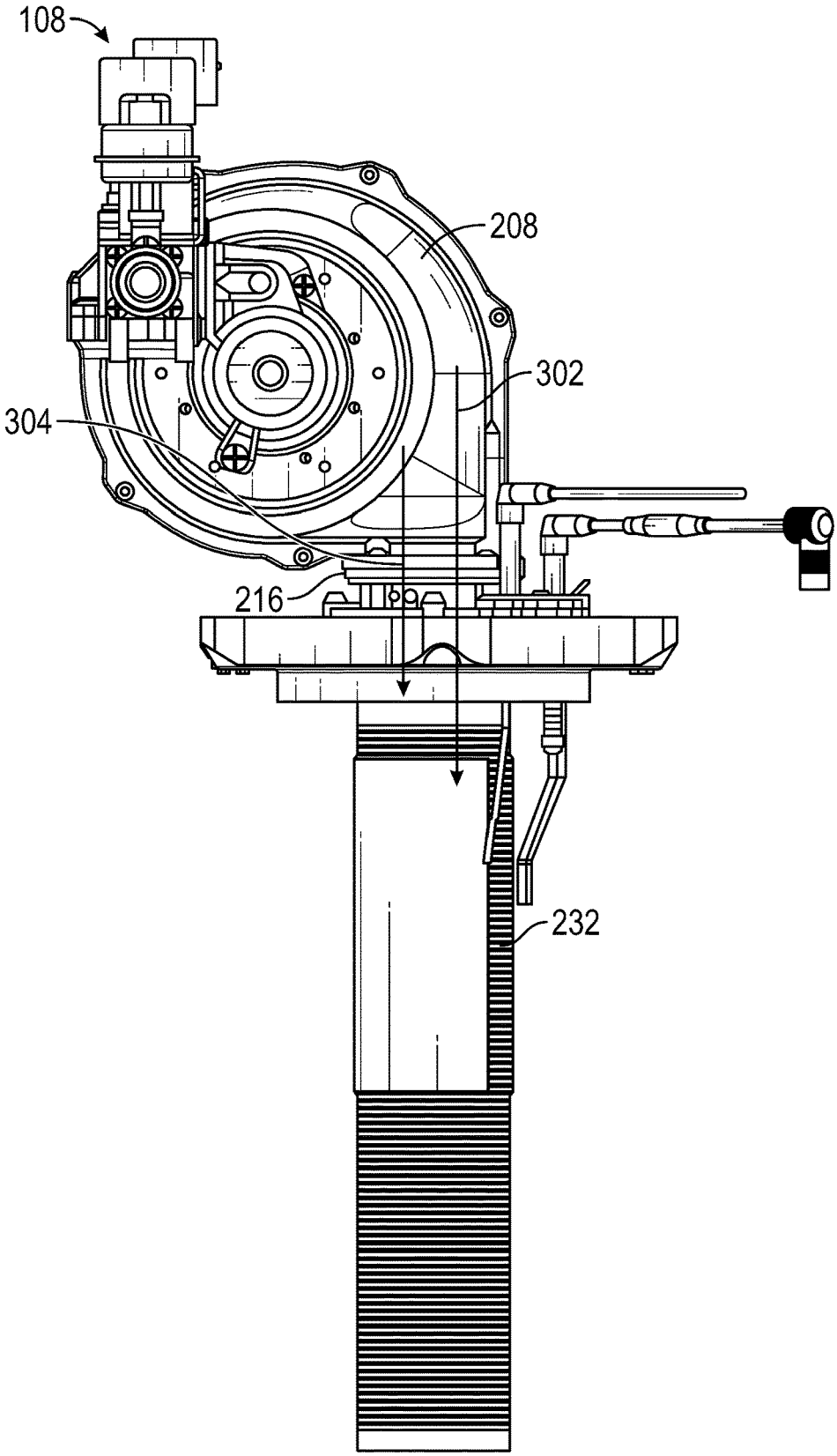
FIG. 3 (Prior Art)
FIG. 3 illustrates an enlarged assembled view of the combustion system of the water heater of FIG. 1.
Figure 4:
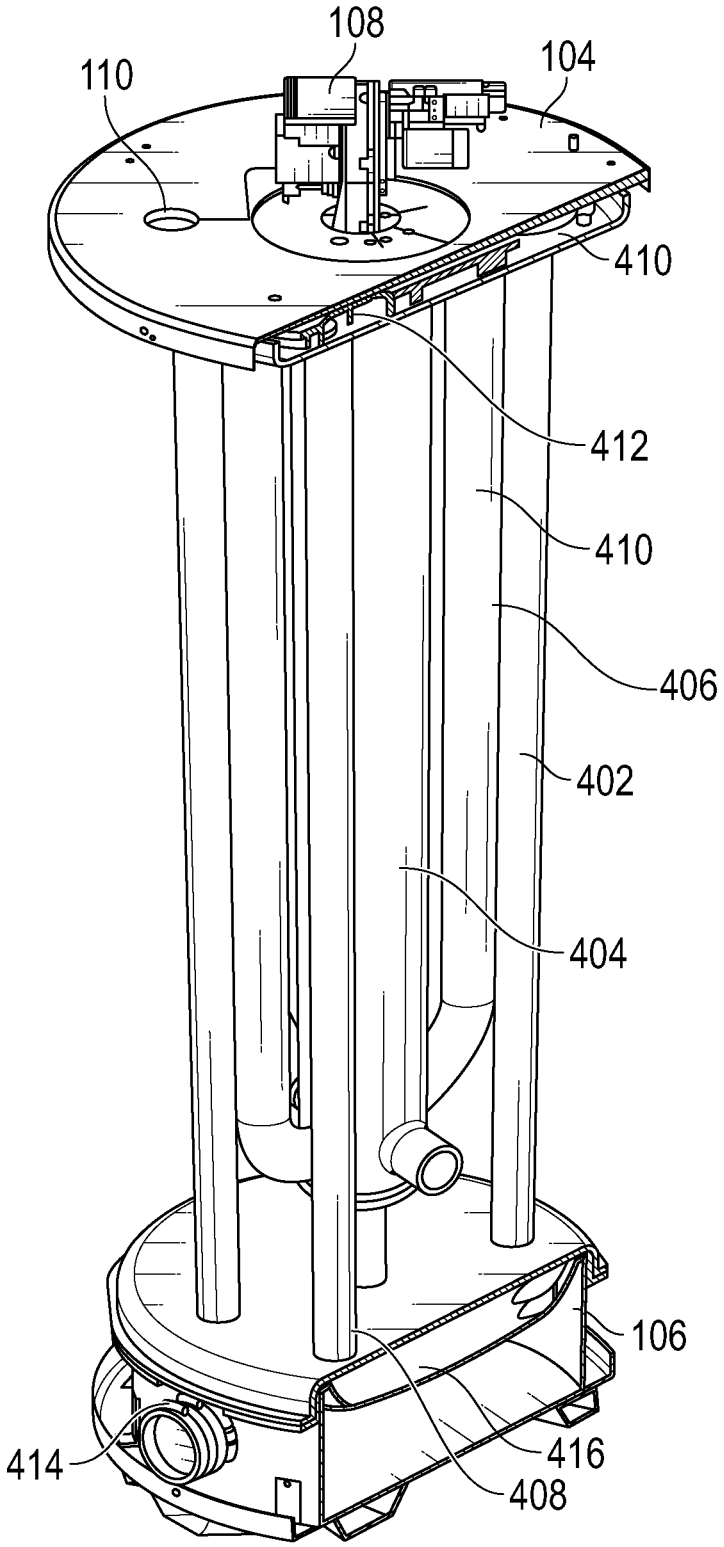
FIG. 4 (Prior Art)
FIG. 4 illustrates a cross-sectional view of the water heater of FIG. 1 without the water tank.
Figure 5:
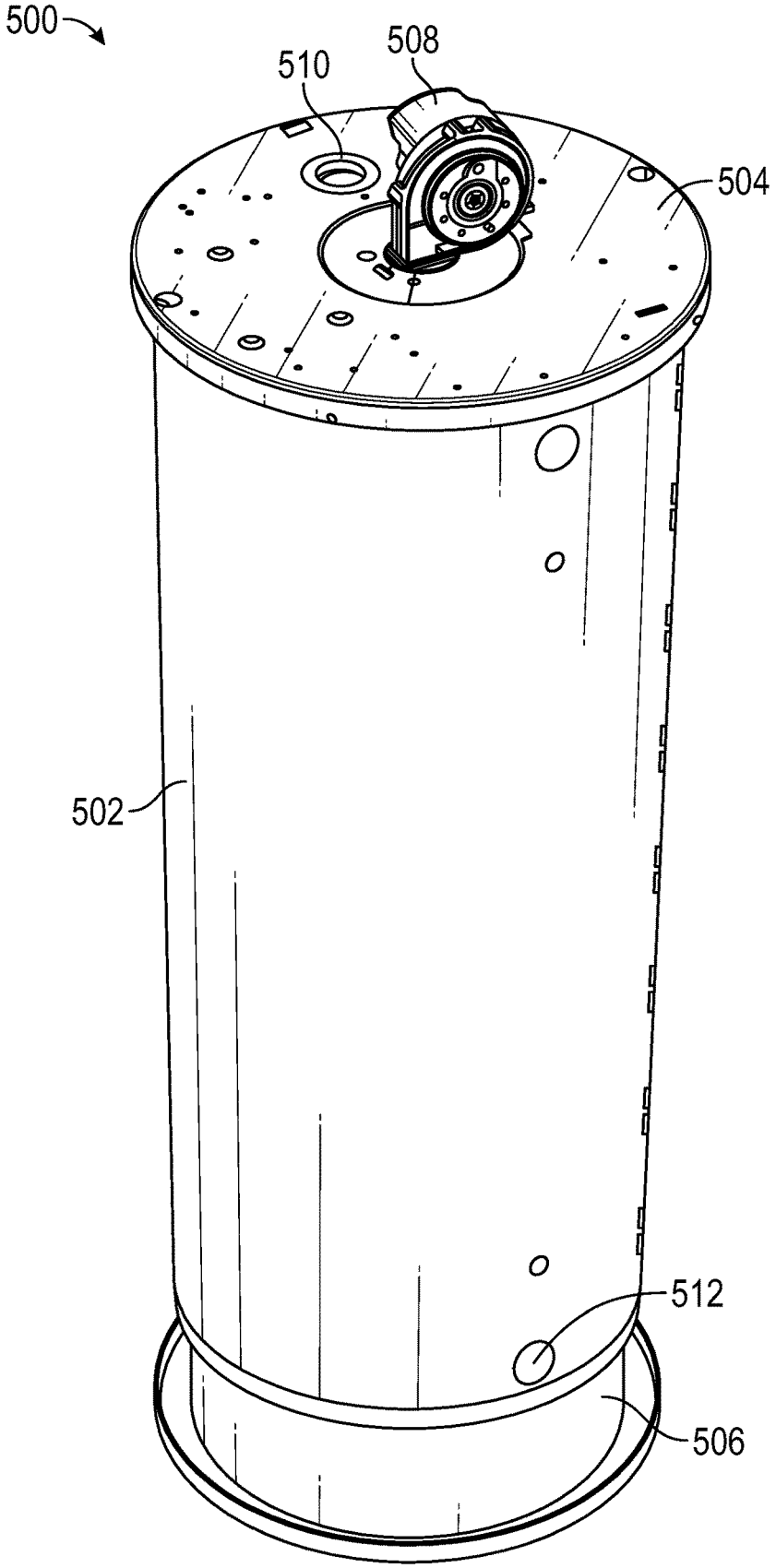
FIG. 5 illustrates a perspective view of a water heater according to one or more embodiments of the present disclosure.

FIG. 5 illustrates a perspective view of a water heater 500 according to an embodiment. In some embodiments, the water heater 500 includes water tank 502, a top cover assembly 504, and a bottom assembly 506. In some instances, the water tank 502 may be a 120 gallon tank. In other instances, the water tank 502 may be greater or less than 120 gallons. The water tank 502 may be any suitable size, shape, or configuration. For example: for one (1) to two (2) people, a 30-40 gallon water tank may be suggested; for two (2) to three (3) people, a 40-50 gallon tank may be suggested; for three (3) to four (4) people, a 50-60 gallon tank may be suggested; for five (5) to (6) people, a 60-80 gallon tank may be suggested. The water heater 500 also includes a combustion system 508 at the top end of the water heater 500. For example, the combustion system 508 may include a down-fired burner, where hot gas flows downward into a multi-pass heat exchanger disposed in the water tank 502. The water heater 500 also includes a water inlet 512 that may be disposed, for example, closer to the bottom end of the water tank 502. The water tank 502 also includes a top water outlet 510 through the top cover assembly 504.

In some embodiments, the top cover assembly 504 includes top flues that interface with second-pass and third-pass flue tubes of the multi-pass heat exchanger. The multi-pass heat exchanger has a configuration that allows the location of the water outlet 510 in the top cover assembly 504 at the top end of the water heater 500. The bottom assembly 506 may also include a bottom flue that interfaces with the third-pass flue tubes of the multi-pass heat exchanger, where the hot gas exits the water heater 500 through a hot gas outlet in the bottom assembly 506.

During operation of the water heater 500, unheated water enters the water tank 502 through the water inlet 512, and gas is heated by the combustion system 508. The unheated water gets heated inside the water tank by hot gas flowing through the multi-pass heat exchanger. The resulting heated water exits the water tank 502 through the top water outlet 510 in the top cover assembly 504. The hot gas that flows through the multi-pass heat exchanger may exit the water tank through a hot gas outlet in the bottom assembly 506.

The water heater 500 provides a top water outlet location along with the high efficiency of a multi-pass heat exchanger. By providing the top water outlet 510, the water heater 500 provides a fuel-fired water heater with a top water outlet location that is preferable in some installations.

In some embodiments, the water heater 500 and/or one or more components of the water heater 500 may have a different shape than shown without departing from the scope of this disclosure. In some alternative embodiments, the water inlet 512 may be at a different location than shown without departing from the scope of this disclosure. In some alternative embodiments, the top water outlet 510 may be at a different location on the top cover assembly than shown without departing from the scope of this disclosure.

Figure 6:
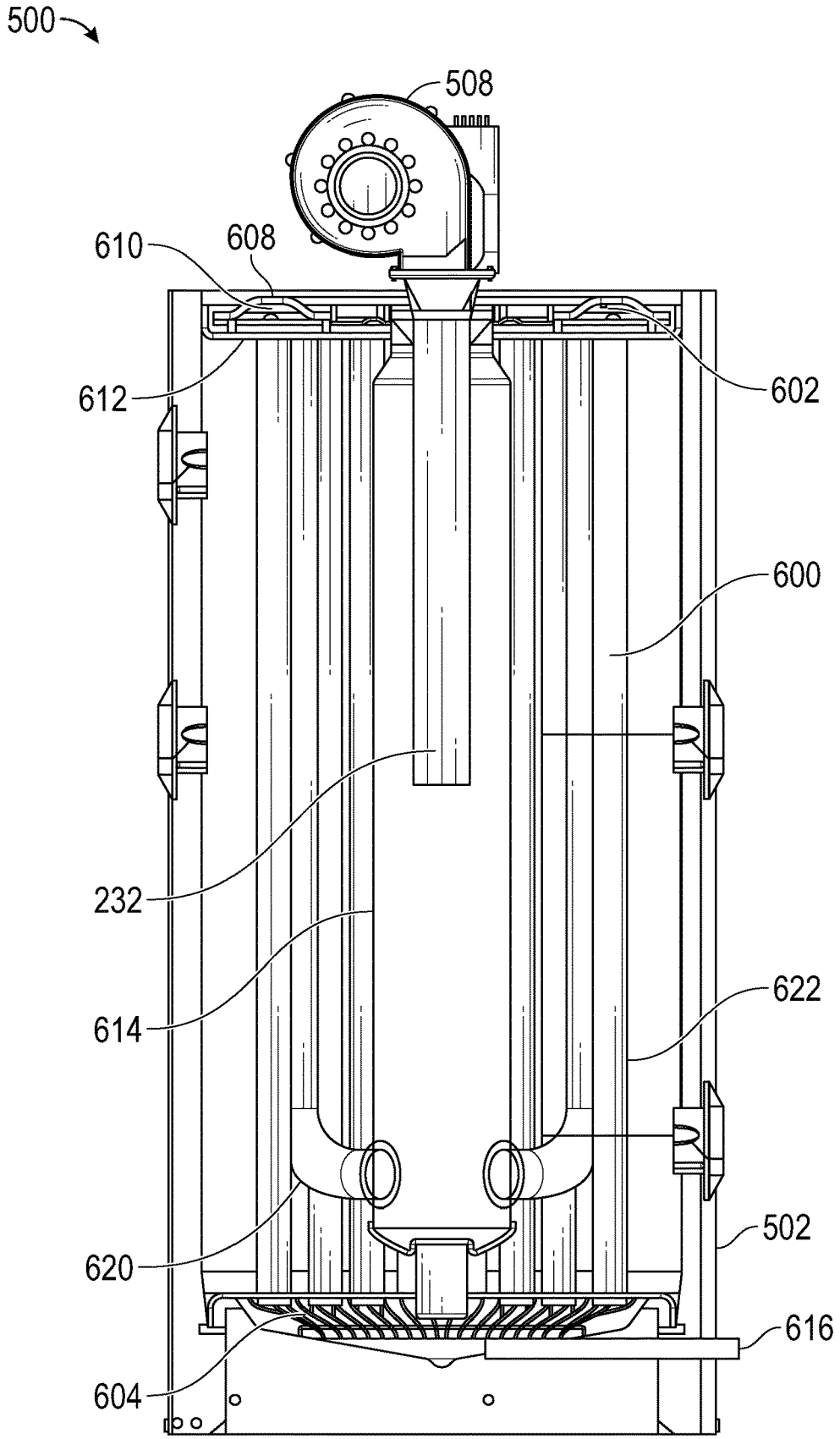
FIG. 6 illustrates a cross-sectional view of the water heater of FIG. 5 according to one or more embodiments of the present disclosure.

FIG. 6 illustrates a cross-sectional view of the water heater of FIG. 5. Referring to FIGS. 5 and 6, in some embodiments, the water heater 500 includes the water tank 502. A multi-pass heat exchanger 600 is positioned in the water tank 502. The multi-pass heat exchanger 600 includes a first-pass flue tube 614, a plurality of second-pass flue tubes, a sample of which is indicated as a second-pass flue tube 620, and a plurality of third-pass flue tubes, a sample of which is indicated as a third-pass flue tube 622.

In some embodiments, the second-pass flue tubes may be substantially parallel to the first-pass flue tube 614 after curving/turning upward. The second-pass flue tubes may branch out from the first-pass flue tube 614 proximal to a bottom end of the water tank 502 and may extend upward for a substantial portion of the height of the water tank 502. In some embodiments, the second-pass flue tubes may have curves or other variations in extending upward toward the top opening of the water tank 502. Top ends of the second-pass flue tubes may be terminated in top flues in the top cover assembly 504 of the water heater 500 or may otherwise be in fluid communication with the top flues in the top cover assembly 504 of the water heater 500. For example, the second-pass flue tubes may be terminated in the top plenum 602.

In some embodiments, the third-pass flue tubes may extend in the cavity of the water tank 502 from the top end of the water tank 502 to a bottom end of the water tank 502. Top end openings of the third-pass flue tubes may be terminated or may otherwise be in fluid communication with the top plenum 602 in the top cover assembly 504. Hot gas from the second-pass flue tubes flows to the third-pass flue tubes through the top plenum 602 in the top cover assembly 504.

In some embodiments, the bottom end openings of the third-pass flue tubes may be terminated in the bottom assembly 506 through openings in a top cover of the bottom assembly 506. For example, the bottom assembly 506 may include the bottom flue 604, and hot gas flowing through the third-pass flue tubes may flow to the bottom flue 604 and exit the bottom assembly 506 through a hot gas outlet 616 of the bottom assembly 506.

In some embodiments, the first-pass flue tube 614, the second-pass flue tubes, and the third-pass flue tubes may be configured with respect to each other to allow for placing the hot water outlet 510 in the top cover assembly 504 of the water heater 500. For example, the second-pass flue tubes may be intermingled with the third-pass flue tubes around the first-pass flue tube 614.

In accordance with aspects of the present disclosure, hot air passed through the first-pass flue tube 614, then through the second-pass flue tubes, and then through the third-pass flue tubes will heat water in the tank.

The combustion system 508 differs from the combustion system 108 discussed above with reference to FIGS. 1-4 in order to improve the heating efficiency of the water heater 500 over that of the water heater 100. This will be described in greater detail with reference to FIGS. 7-9B.

Figure 7:
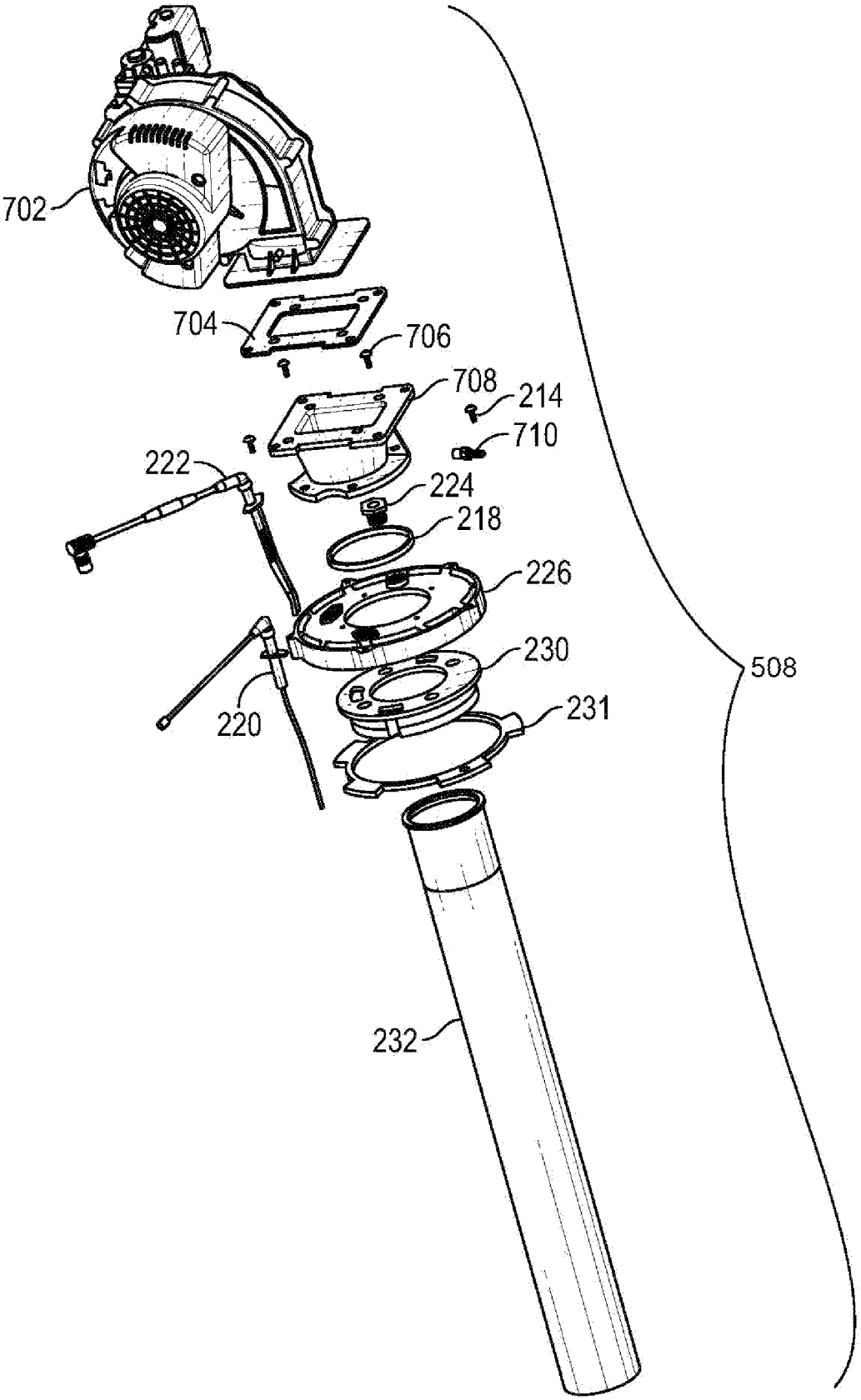
FIG. 7 illustrates an exploded disassembled view of the combustion system of the water heater of FIG. 5 according to one or more embodiments of the present disclosure.

FIG. 7 illustrates an exploded disassembled view of the combustion system 508 of the water heater of FIG. 5.

Referring to FIG. 7, the combustion system 508 includes a blower 702, a compressible blower gasket 704, a plurality of screws 706, a blower collar 708, a flow sensor 710, the plurality of screws 214, the burner gasket 218, the flame sensor rod 220, the igniter (with cable) 222, the sightglass fitting 224, the burner mounting plate 226, the gasket 228, the burner plate 230, a burner plate gasket 231, and the burner mesh 232.

The blower 702 is a system that blows a mixture of air and a combustible gas as mixed by an internal valve. In accordance with aspects of the present disclosure, the blower 702 is configured to have a non-circular cross-sectional output. In some instances, the non-circular cross-sectional output of the blower 702 is rectangular with rounded edges. However, any non-circular shape may be used, such as ellipses and polyhedrons. This is to be contrasted with circular cross-sectional output of the blower 208 of the combustion system 108 discussed above with reference to FIG. 2.

The compressible blower gasket 704 prevents the air/gas mixture from the blower 702 from escaping between the blower 702 and the blower collar 708. The compressible blower gasket 704 may be any known compressible heat resistant material, non-limiting examples of which include silicone or ethylene propylene diene monomer rubber (EPDM). The plurality of screws 706 are used to fasten the blower 702 to the blower collar 708. The blower collar 708 is used to mount the blower 702 to the burner mounting plate 226. The burner gasket 218 prevents combusted gases from escaping between the burner mounting plate 226 and the burner plate 230. The flame sensor rod 220 detects whether the air/gas mixture as provided by the blower 708 has been ignited. The igniter (with cable) 222 ignites the air/gas mixture as provided by the blower 708. The burner mounting plate 226 receives the blower collar 708, having the blower 702 fastened thereon. The gasket 228 prevents combusted gas from expelling from between the burner mounting plate 226 and the burner plate 230. The burner mounting plate 226 is configured to mount the combustion system 508 to the top cover assembly 504, as shown in FIG. 5. The burner gasket 231 seals the burner plate 230 to the water heater tank head preventing combustion products from escaping. The burner gasket 231 may be a type of silicone for safety but EPMD could be used if the temperatures are sufficiently low.

The blower 702 blows out a mixture of air and a combustible gas past the blower collar 708 and into the burner mesh 232 to be ignited by the igniter 222. The ignited mixture of air and gas is used to heat water stored in the water heater 500. The flow sensor 710 detects flow of the mixture of air and the combustible gas from the blower 702 and outputs a signal when the flow drops below a predetermined threshold.

In general, the combustion system 508 differs from combustion system 108 discussed above with reference to FIGS. 2 and 3, in that the blower 702 has a non-circular cross-sectional output (with a corresponding non-circular cross-sectional compressional blower gasket 704 to match), and the blower collar 708 has a non-circular cross sectional input and a circular cross sectional output. This will be described in greater detail with reference to FIGS. 8A-8E.

Figure 8A:
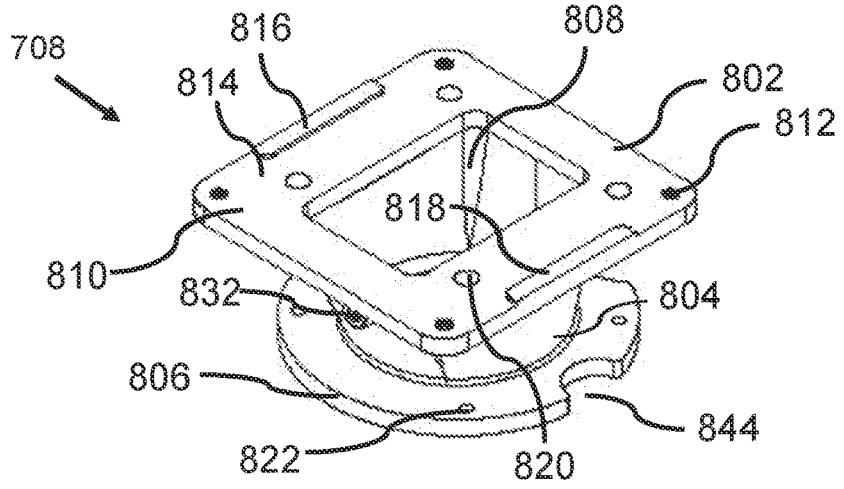
FIG. 8A illustrates a perspective view of the blower collar of the water heater of FIG. 5 according to one or more embodiments of the present disclosure.
Figure 8B:
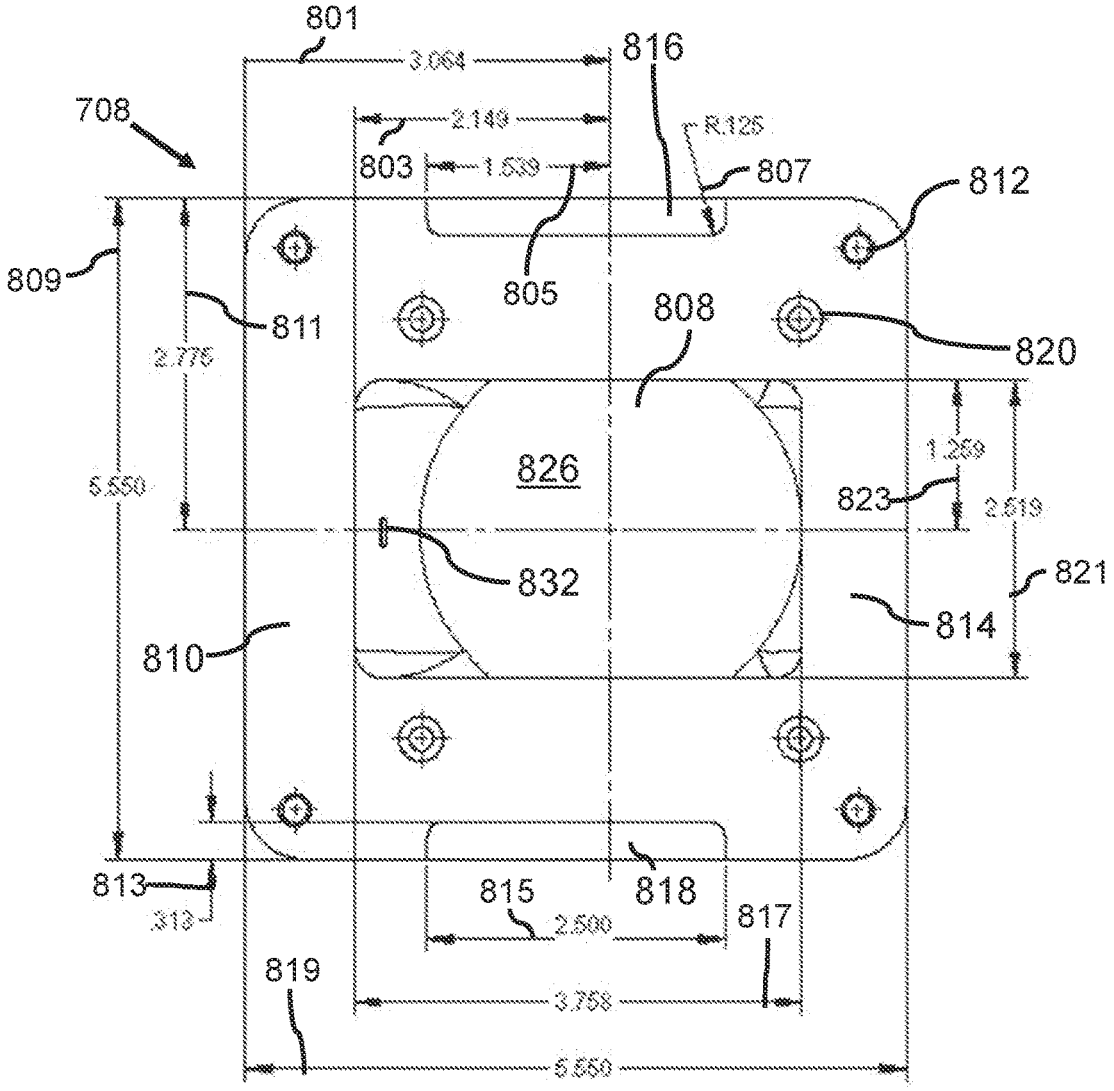
FIG. 8B illustrates a top view of the blower collar of FIG. 8A according to one or more embodiments of the present disclosure.
Figure 8C:
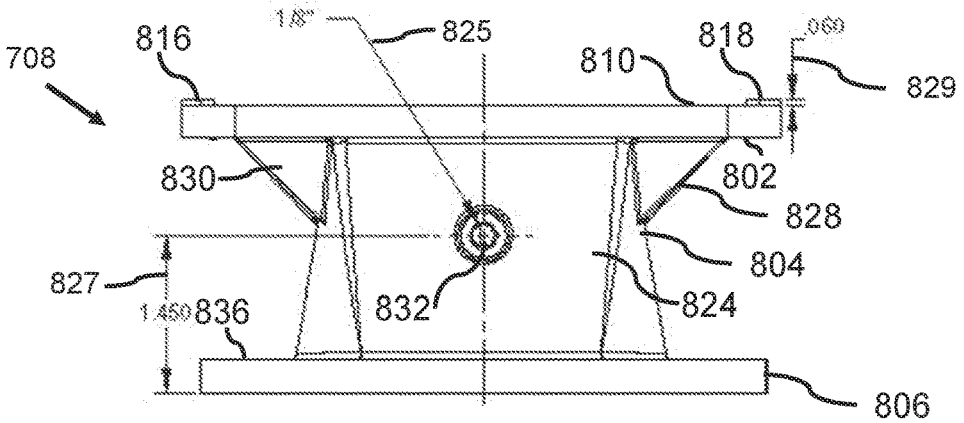
FIG. 8C illustrates a side view of the blower collar of FIG. 8A according to one or more embodiments of the present disclosure.
Figure 8D:
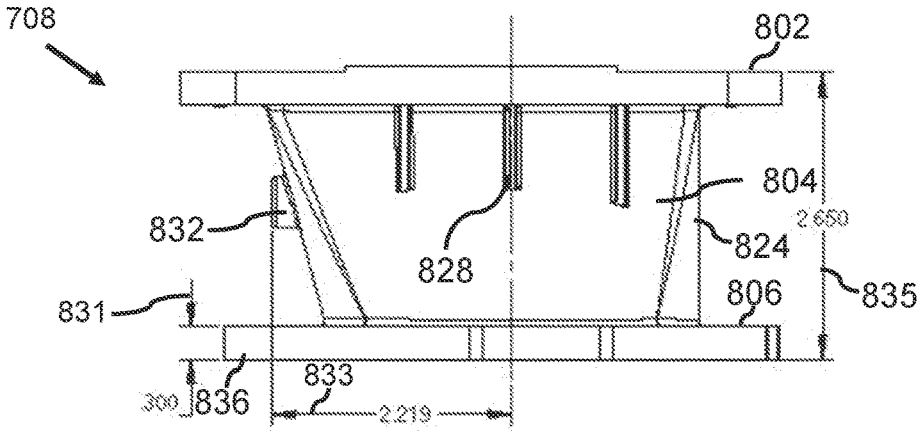
FIG. 8D illustrates another side view of the blower collar of FIG. 8A according to one or more embodiments of the present disclosure.
Figure 8E:
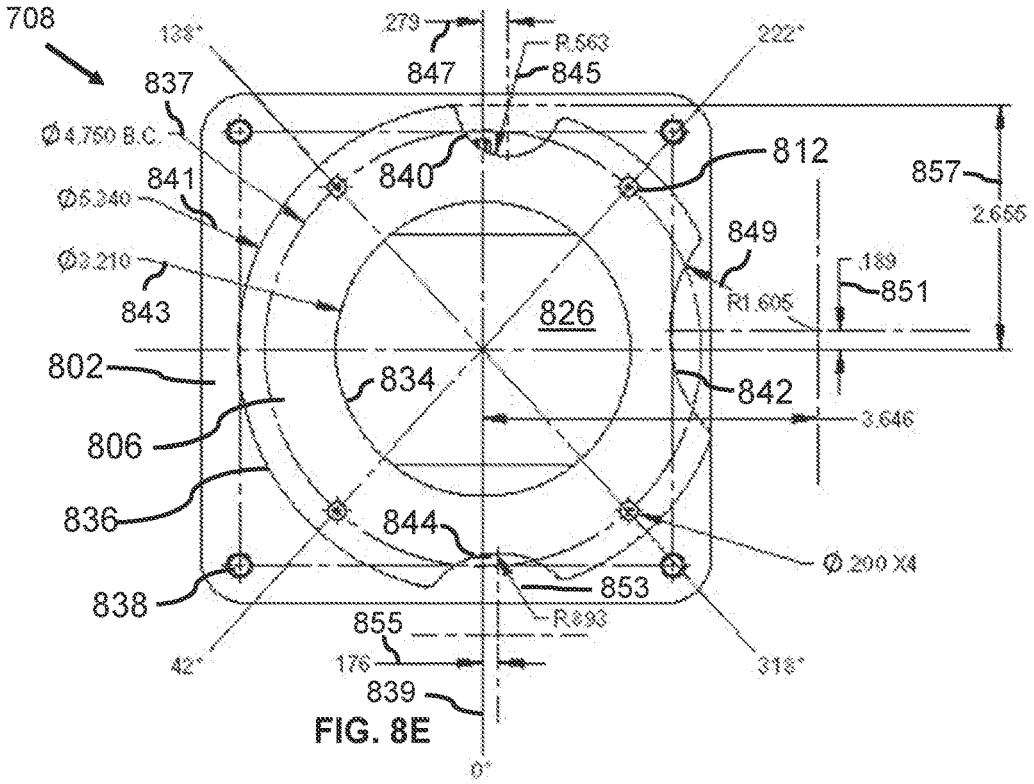
FIG. 8E illustrates a bottom view of the blower collar of FIG. 8A according to one or more embodiments of the present disclosure.

FIG. 8A illustrates a perspective view of the blower collar 708 of the water heater 500 of FIG. 5 according to an embodiment. FIG. 8B illustrates a top view of the blower collar 708 of FIG. 8A. FIG. 8C illustrates a side view of the blower collar 708 of FIG. 8A. FIG. 8D illustrates another side view of the blower collar 708 of FIG. 8A. FIG. 8E illustrates a bottom view of the blower collar 708 of FIG. 8A.

As shown in FIG. 8A, blower collar 708 includes an upper portion 802, a central portion 804 and a bottom portion 806.

The upper portion 802 has a non-circular opening 808 surrounded by a blower mounting rim 810 having a plurality of blower mounting holes, a sample of which is indicated as blower mounting hole 812. The blower mounting rim 810 includes a gasket-receiving recessed face 814, a protruding planar physical stop 816 on a first side and a protruding planar physical stop 818 on a second side. The protruding planar physical stop 816 and the protruding planar physical stop 818 protrude from the gasket-receiving recessed face 814. The gasket-receiving recessed face 814 is configured to receive the compressible blower gasket 704 such that the compressible blower gasket 704 does not cover either the protruding planar physical stop 816 or the protruding planar physical stop 818.

In this embodiment, the non-circular opening 808 is generally rectangular, with curved corners. However, any non-circular shape may be used, such as ellipses and polyhedrons. The non-circular opening 808 is configured to match that non-circular output of the blower 702, and the corresponding opening in the compressible blower gasket 704. As will be described in greater detail below, as an inner pass through 826 changes in shape from the non-circular opening 808 to the shape of the opening at the bottom of the blower collar 708, the effectiveness of the blower collar 708 to mix the air and gas as provided by the blower 702 additionally increases. The non-circular opening 808 and the opening at the bottom of the blower collar 708 are based on the mating parts. In particular the non-circular opening 808 will have a shape that corresponds to a shape of the output of a corresponding blower, whereas the opening at the bottom of the blower collar 708 will have a shape that corresponds to the shape of a first-past flue tube. The blower 702 and the burner might change in size, which would impact the size of the gasket-receiving recessed face 814 or the bottom portion 806.

Since the blower 702 is a snail-shell shape, as the output air moves through the spiral canal, one side will have a higher flow rate than the other. In particular, as shown in FIG. 7, the air leaving the blower 702 at the side 712, which passes through the compressible blower gasket 704 and into the side 714 of the blower collar 708, moves at a greater speed than the air leaving the blower 702 at the side 716, which passes through the compressible blower gasket 704 and into the side 718 of the blower collar 708. The change in shape of the non-circular opening 808 is to help even that flow. The change in shape of the openings helps in ignition to deliver the mixture of air and gas with a more even pressure to the burner ports.

The function of the gasket-receiving recessed face 814, the protruding planar physical stop 816 and the protruding planar physical stop 818 will be described in greater detail with reference to FIGS. 9A and 9B.

Figure 9A:
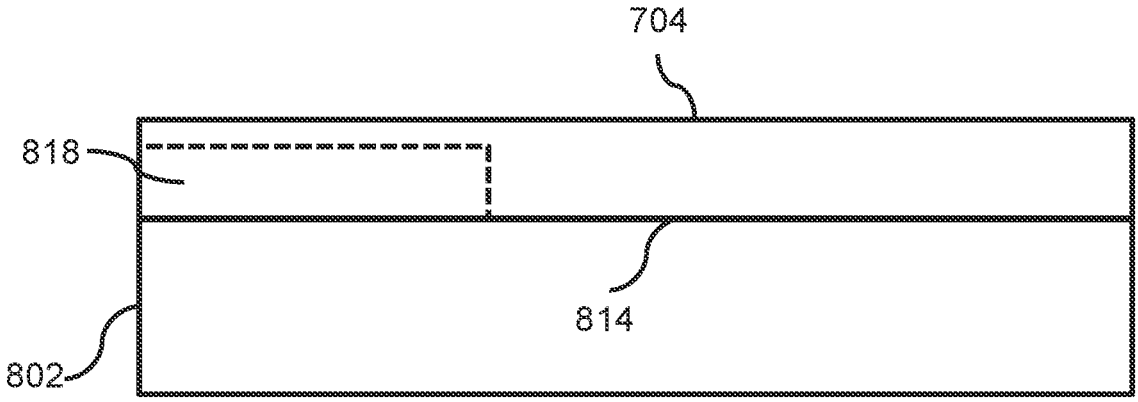
FIG. 9A shows a side view of an upper portion of the blower collar with a compressible blower gasket disposed thereon according to one or more embodiments of the present disclosure.

FIG. 9A shows a side view of the upper portion 802 with the compressible blower gasket 704 disposed thereon. As shown in the figure, the compressible blower gasket 704 resides on the gasket-receiving recessed face 814 is greater in thickness than the protruding planar physical stop 818.

Figure 9B:
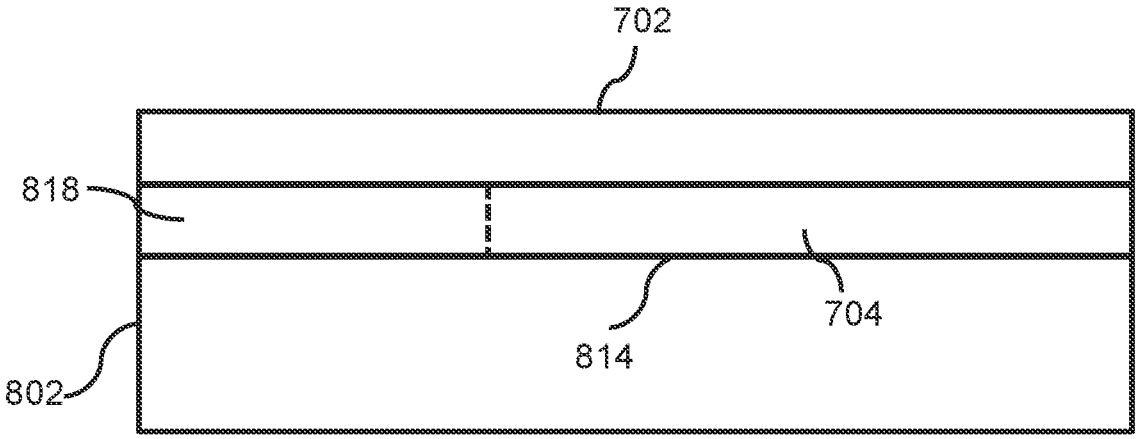
FIG. 9B shows a side view of an upper portion of the blower collar of FIG. 9A with a compressible blower gasket disposed thereon and with a blower mounted thereon according to one or more embodiments of the present disclosure.

FIG. 9B shows a side view of the upper portion 802 with the compressible blower gasket 704 disposed thereon and with the blower 702 mounted thereon.

As shown in the figure, the blower 702 compresses the compressible blower gasket 704 forming a tight seal between the blower 702 and the upper portion 802. However, the protruding planar physical stop 818 actually supports (with the protruding planar physical stop 816) the blower 702. Without the protruding planar physical stop 818 and the protruding planar physical stop 816, the blower 702 may be unstable (e.g., rock or wobble) if it were only supported by a compressible gasket.

The blower mounting holes, including the sample of which is indicated as blower mounting hole 812 as shown in FIG. 8A, are configured to receive the blower mounting screws so as to mount the blower mounting rim 810 to the blower 708. In some embodiments, the blower mounting holes may be threaded such that the blower mounting screws may screw directly into the blower mounting holes. In other embodiments, the blower mounting screws may be replaced with blower mounting bolts, such that the blower mounting holes may pass the blower mounting bolts to engage with corresponding blower mounting nuts on the underside of the upper portion 802.

The blower mounting rim 810 additionally includes a plurality of clearance holes, a sample of which is indicated by a clearance hole 820. Each clearance hole aligns with a respective burner mounting hole, a sample of which is indicated as a burner mounting hole 822 in the bottom portion 806 to enable insertion and removal of the respective burner mounting screws.

The central portion 804 is between the bottom portion 806 and the upper portion 802. As shown in FIG. 8C, the central portion 804 has a surrounding wall 824 connected to the top portion 802 and the lower portion 806. As shown in FIG. 8B, the surrounding wall 824 surrounds an inner pass through 826 having a cross-sectional shape that changes from the non-circular opening 808 of the upper portion 802 to a circular opening of the bottom portion 806. Again, as mentioned above, the changing cross-sectional shape of inner pass through 826 increases the effectiveness of mixing of air and gas as provided by the blower 702.

In some instances the central portion 804 is from 2 to 5 inches in height, such as to mate with a 70 mm burner. In some instances, the height of the central portion 804 may be lowered such that the entire combustion system 508 may be lower than 80 inches, which is the maximum height for door clearances. In some cases, the inner pass through 826 is smooth, whereas in other cases, the inner pass through is stepped.

In one example: the distance from the outer edge of the blower mounting rim 810 to the center of the inner pass through 826 is 3.064 inches, as shown by the double arrow 801; the distance from the inner edge of the blower mounting rim 810 to the center of the inner pass through 826 is 2.149 inches, as shown by the double arrow 803; the distance from the edge of the protruding planar physical stop 816 to the center of the inner pass through 826 is 1.539 inches, as shown by the double arrow 805; the radial curve of the edge of the protruding planar physical stop is 0.126 inches, as shown by arrow 807; the distance from the outer edge of the protruding planar physical stop 816 to the outer edge of the protruding planar physical stop 818 is 5.550 inches, as shown by the double arrow 809; the distance from the outer edge of the protruding planar physical stop 816 to the center of the inner pass through 826 is 2.775 inches, as shown by the double arrow 811; the distance from the outer edge of the protruding planar physical stop 818 to the inner edge of the protruding planar physical stop 818, is 0.313 inches, as shown by the double arrow 813; the width of the protruding planar physical stop 818 is 2.500 inches, as shown by the double arrow 815; the length of the non-circular opening 808 is 3.758 inches, as shown by the double arrow 817; the distance from the outer edge of the blower mounting rim 810 to the outer edge of the blower mounting rim 810 is 5.550 inches, as shown by the double arrow 819; the distance from the inner edge of the non-circular opening 808 to the center of a sensor port 832 is 1.259 inches as shown by the double arrow 823; and the width of the non-circular opening 808 is 2.519 inches, as shown by the double arrow 821.

As shown in FIG. 8C, the central portion 804 additionally may include a set of structural support ribs 828 on a first side that connect with an underside of the blower mounting rim 810 and a set of structural support ribs 830 on a second side that connect with the underside of the blower mounting rim 810. The mounted blower 702 will have an offset center of gravity, which will create a moment with respect to blower collar 708. These structural support ribs provide additional structural support to upper portion 802 to account for any moment associated with the mounted blower 702.

As shown in FIG. 8C, the central portion 804 additionally may include the sensor port 832 configured to receive the flow sensor to enable the flow sensor 710 to detect gas flow through the inner pass through 826.

In one example: the sensor port 832 has a radius of ⅛ inches, as shown by arrow 825; the distance from the bottom of the blower collar 708 to the center of the sensor port 832 is 1.450 inches, as shown by the double arrow 827; and the height of the protruding planar physical stops 818 and 818 is 0.060 inches, as shown by the double arrow 829.

As shown in FIG. 8D, in one example: the thickness of the 836 is 0.300 inches as indicated by the double arrow 831; the distance from the front of the sensor port 832 to the center of the inner passthrough 826 is 2.219 inches as indicated by the double arrow 833; and the height from the bottom of the blower collar 708 to the top surface of the upper portion 802 is 2.650 inches as indicated by the double arrow 835.

As shown in FIG. 8E, the bottom portion 806 has a circular opening 834 surrounded by a burner mounting rim 836 having a plurality of burner mounting holes, a sample of which is indicated as a burner mounting hole 838. The burner mounting holes are configured to receive respective burner mounting screw so as to mount the burner mounting rim 836 to the burner mounting plate 226.

The bottom portion additionally may include a cut-out 840, a cut-out 842, and a cut-out 844. The cut-out 840 enables the sightglass fitting 224 to have access to the first-pass flue tube 404, whereas the cut-out 842 enables the igniter 222 to be inserted into the first-pass flue tube 404, and whereas the cut-out 844 enables the flame sensor rod 220 to be inserted into the first-pass flue tube 404.

In one example: the blower mounting holes are disposed on a bolt circle having a radius of 4.750 degrees as shown by an arrow 837 and are located from a 0 degree axis as shown by a line 839 at 42 degrees, 138 degrees, 222 degrees and 318 degrees, respectively; the bottom portion 806 has an outer radius of 5.340 inches, as indicated by an arrow 841; the circular opening 834 has a radius of 3.210 inches, as indicated by an arrow 843; the cut-out 840 has a radius of 0.563 inches, as indicated by an arrow 845, and is offset from the center of the circular opening 834 by a distance of 0.279 inches, as indicated by a double arrow 847; the cut-out 842 has a radius of 1.605 inches, as indicated by an arrow 849, and is offset from the center of the circular opening 834 by a distance of 0.189 inches, as indicated by a double arrow 851; the cut-out 844 has a radius of 0.893 inches, as indicated by an arrow 853, and is offset from the center of the circular opening 834 by a distance of 0.176 inches, as indicated by a double arrow 855; and the bottom portion 806 has a radius of 2.655 inches as indicated by a double arrow 857.

A water heater in accordance with aspects of the present disclosure improvise efficiency over that of prior art water heaters. In particular, water heater in accordance with aspects of the present disclosure includes a blower collar that has an inner pass through having a cross-sectional shape that changes from the non-circular opening that matches that of the blower to a circular opening to match that of the burner plate. With such a changing pass through, the air and gas are more effectively mixed, which leads to a more efficient burn.

It should be apparent that the foregoing relates only to certain embodiments of the present application and that numerous changes and modifications may be made herein by one of ordinary skill in the art without departing from the general spirit and scope of the disclosure.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A blower collar for use with a blower and a burner, the blower collar comprising:

a bottom portion having a circular opening surrounded by a burner mounting rim configured to be mounted to the burner;

an upper portion having a non-circular opening surrounded by a blower mounting rim and being configured to mount to the blower;

wherein the blower mounting rim includes a gasket-receiving recessed face, a first protruding planar physical stop on a first side, and a second protruding planar physical stop on a second side, wherein the first protruding planar physical stop and the second protruding planar physical stop protrude from the gasket-receiving recessed face, and wherein the gasket-receiving recessed face is configured to receive a compressible blower gasket such that the compressible blower gasket does not cover either the first protruding planar physical stop or the second protruding planar physical stop; and a central portion between the bottom portion and the upper portion, wherein the central portion includes a surrounding wall extending between the burner mounting rim and the blower mounting rim, and wherein the surrounding wall surrounds an inner pass through having a cross-sectional shape that changes from the non-circular opening of the upper portion to the circular opening of the bottom portion.

2. The blower collar of claim 1, wherein the upper portion has a rectangular opening as the non-circular opening.

3. The blower collar of claim 1, wherein the central portion includes a first set of structural support ribs on a first side that connect with an underside of the blower mounting rim and a second set of structural support ribs on a second side that connect with the underside of the blower mounting rim.

4. The blower collar of claim 1, wherein the central portion includes a first set of structural support ribs on a first side below the first protruding planar physical stop and a second set of structural support ribs on a second side below the second protruding planar physical stop, wherein the first set of structural support ribs connect with an underside of the blower mounting rim, and wherein the second set of structural support ribs connect with the underside of the blower mounting rim.

5. The blower collar of claim 1, wherein the burner mounting rim has a burner mounting hole configured to receive a burner mounting screw to mount the burner mounting rim to the burner, and wherein the blower mounting rim includes a clearance hole that aligns with the burner mounting hole in the burner mounting rim of the bottom portion to enable insertion and removal of the burner mounting screw.

6. The blower collar of claim 1, wherein the central portion includes a sensor port configured to receive a flow sensor to enable the flow sensor to detect gas flow through the inner pass through.

7. The blower collar of claim 1, wherein the blower mounting rim has a blower mounting hole configured to receive a blower mounting screw to mount the blower mounting rim to the blower, and wherein the blower mounting hole includes a threaded portion configured to receive the blower mounting screw.

8. A heat generating system for use with a water tank, the heat generating system comprising:

a blower;

a compressible blower gasket;

a burner configured to be mounted within the water tank; and a blower collar configured to be mounted to the burner and to the blower outside of the water tank;

wherein the blower collar comprises:

a bottom portion having a circular opening surrounded by a burner mounting rim configured to mount to the burner;

an upper portion having a non-circular opening surrounded by a blower mounting rim having a blower mounting hole and being configured to mount the blower mounting rim to the blower;

wherein the blower mounting rim includes a gasket-receiving recessed face, a first protruding planar physical stop on a first side, and a second protruding planar physical stop on a second side, wherein the first protruding planar physical stop and the second protruding planar physical stop protrude from the gasket-receiving recessed face, and wherein the gasket-receiving recessed face is configured to receive the compressible blower gasket such that the compressible blower gasket does not cover either the first protruding planar physical stop or the second protruding planar physical stop; and a central portion between the bottom portion and the upper portion, wherein the central portion includes a surrounding wall connected to the burner mounting rim and the blower mounting rim, and wherein the surrounding wall surrounds an inner pass through having a cross-sectional shape that changes from the non-circular opening of the upper portion to the circular opening of the bottom portion.

9. The heat generating system of claim 8, wherein the upper portion has a rectangular opening as the non-circular opening.

10. The heat generating system of claim 8, wherein the central portion includes a first set of structural support ribs on a first side that connect with an underside of the blower mounting rim and a second set of structural support ribs on a second side that connect with the underside of the blower mounting rim.

11. The heat generating system of claim 8, wherein the burner mounting rim has a burner mounting hole configured to receive a burner mounting screw to mount the burner mounting rim to the burner, and wherein the blower mounting rim includes a clearance hole that aligns with the burner mounting hole in the burner mounting rim of the bottom portion to enable insertion and removal of the burner mounting screw.

12. The heat generating system of claim 8, further comprising:

a flow sensor, wherein the central portion includes a sensor port configured to receive the flow sensor to enable the flow sensor to detect gas flow through the inner pass through.

13. The heat generating system of claim 8, wherein the blower mounting rim has a blower mounting hole configured to receive a blower mounting screw to mount the blower mounting rim to the blower, and wherein the blower mounting hole includes a threaded portion configured to receive the blower mounting screw.

14. A water heater comprising:

a water tank configured to store water therein;

a blower configured to blow a combustible gas;

a compressible blower gasket;

a burner configured to be mounted within the water tank and to ignite the combustible gas to generate heat to heat the water; and a blower collar configured to be mounted to the burner and to the blower outside of the water tank, wherein the blower collar comprises:

a bottom portion having a circular opening surrounded by a burner mounting rim configured to mount to the burner;

an upper portion having a non-circular opening surrounded by a blower mounting rim having a blower mounting hole and being configured to mount to the blower;

wherein the blower mounting rim includes a gasket-receiving recessed face, a first protruding planar physical stop on a first side, and a second protruding planar physical stop on a second side, wherein the first protruding planar physical stop and the second protruding planar physical stop protrude from the gasket-receiving recessed face, and wherein the gasket-receiving recessed face is configured to receive the compressible blower gasket such that the compressible blower gasket does not cover either the first protruding planar physical stop or the second protruding planar physical stop; and a central portion between the bottom portion and the upper portion, wherein the central portion includes a surrounding wall connected to the burner mounting rim and the blower mounting rim, and wherein the surrounding wall surrounds an inner pass through having a cross-sectional shape that changes from the non-circular opening of the upper portion to the circular opening of the bottom portion.

15. The water heater of claim 14, wherein the upper portion has a rectangular opening as the non-circular opening.

16. The water heater of claim 14, wherein the central portion includes a first set of structural support ribs on a first side that connect with an underside of the blower mounting rim and a second set of structural support ribs on a second side that connect with the underside of the blower mounting rim.

17. A blower collar for use with a blower and a burner, the blower collar comprising:

a bottom portion having a circular opening surrounded by a burner mounting rim configured to be mounted to the burner;

an upper portion having a non-circular opening surrounded by a blower mounting rim and being configured to mount to the blower; and a central portion between the bottom portion and the upper portion, wherein the central portion includes a surrounding wall extending between the burner mounting rim and the blower mounting rim, and wherein the surrounding wall surrounds an inner pass through having a cross-sectional shape that changes from the non-circular opening of the upper portion to the circular opening of the bottom portion, wherein the central portion includes a first set of structural support ribs on a first side that connect with an underside of the blower mounting rim and a second set of structural support ribs on a second side that connect with the underside of the blower mounting rim.

* * * * *